US005451341A

United States Patent [19]

White

[11] Patent Number: 5,451,341

[45] Date of Patent: Sep. 19, 1995

[54] SOIL RELEASE POLYMER IN DETERGENT COMPOSITIONS CONTAINING DYE TRANSFER INHIBITING AGENTS TO IMPROVE CLEANING PERFORMANCE

[75] Inventor: Chiquita V. White, Cincinnati, Ohio

[73] Assignee: The Procter & Gamble Company, Cincinnati, Ohio

[21] Appl. No.: 119,922

[22] Filed: Sep. 10, 1993

[51] Int. Cl.[6] ..... C11D 1/75; C11D 3/28; C11D 3/34; D06M 13/388

[52] U.S. Cl. ..... 252/547; 252/548; 252/546; 252/DIG. 1; 252/DIG. 2; 252/DIG. 3; 252/DIG. 4; 252/DIG. 15; 252/DIG. 7; 252/549; 252/550; 252/551; 252/552; 252/553; 252/545; 252/554; 252/555; 252/556; 252/557; 252/558; 252/559; 252/174.21; 252/174.22; 252/174.23; 8/137

[58] Field of Search ..... 252/8.6, 8.7, 8.8, 8.75, 252/544, 547, 548, 546, DIG. 1, DIG. 2, DIG. 3, DIG. 4, DIG. 15, DIG. 7, 549, 550, 551, 552, 553, 545, 554, 555, 556, 557, 558, 559, 174.21, 174.22, 174.23, 174.24; 8/137

[56] References Cited

U.S. PATENT DOCUMENTS

| | | | |
|---|---|---|---|
| 4,548,744 | 10/1985 | Connor | 252/545 |
| 4,702,857 | 10/1987 | Gosselink | 252/174.23 X |
| 4,711,730 | 12/1987 | Gosselink et al. | 252/174.23 X |
| 4,721,580 | 1/1988 | Gosselink | 252/90 |
| 4,861,512 | 8/1989 | Gosselink | 252/174.23 X |
| 4,925,577 | 5/1990 | Borcher et al. | 252/8.6 X |
| 4,968,451 | 11/1990 | Scheibel et al. | 252/549 |
| 4,976,879 | 12/1990 | Maldonado et al. | 252/174.23 X |
| 5,041,230 | 8/1991 | Borcher et al. | 252/8.6 X |
| 5,182,043 | 1/1993 | Morrall et al. | 252/8.6 X |
| 5,196,133 | 3/1993 | Leslie et al. | 252/558 X |
| 5,273,676 | 12/1993 | Boeckh et al. | 252/174.21 |

FOREIGN PATENT DOCUMENTS

| | | | |
|---|---|---|---|
| 0327927 | 6/1988 | European Pat. Off. | C11D 3/37 |

*Primary Examiner*—Paul Lieberman
*Assistant Examiner*—Douglas J. McGinty
*Attorney, Agent, or Firm*—George W. Allen; Ken K. Patel

[57] ABSTRACT

A granular detergent composition containing a mixture of dye transfer inhibiting agents in combination with a soil release agent is provided. The detergent composition overcomes cleaning deficiencies experienced as a result of the inclusion of dye transfer inhibiting agents. The granular detergent composition having comprises, by weight: (a) from about 1% to about 50% of a detersive surfactant; (b) from about 1% to about 80% of a builder; (c) from about 0.01% to about 10% of a polyamine N-oxide polymer; (d) from about 0.01% to about 10% of a copolymer of N-vinylpyrrolidone and N-vinylimidazole; and (e) from about 0.01% to about 20% of a sulfonated poly-ethoxy/propoxy end-capped ester oligomer.

14 Claims, No Drawings

SOIL RELEASE POLYMER IN DETERGENT COMPOSITIONS CONTAINING DYE TRANSFER INHIBITING AGENTS TO IMPROVE CLEANING PERFORMANCE

FIELD OF THE INVENTION

The present invention generally relates to a detergent composition containing dye transfer inhibiting agents for inhibiting dye transfer among fabrics during laundering processes. More particularly, the invention provides a detergent composition containing dye transfer inhibiting agents in combination with a soil release poller to increase the cleaning performance of such a composition.

BACKGROUND OF THE INVENTION

One of the most persistent and troublesome problems arising during conventional laundering operations is the tendency of some colored fabrics to release dye or dyes into the laundering solutions. These so-called fugitive dyes are then transferred onto other fabrics oftentimes having colors different than the fugitive dyes. This problem is commonly referred to in the an as "dye transfer". Conveniently, the coloring matter in the "dirt" on the fabrics being laundered which may likewise be transferred to other fabrics in the laundering solution is included within the meaning of dye transfer.

As is known, one way of overcoming the dye transfer problem is to complex or otherwise absorb the fugitive dyes before they have the opportunity to become attached to other fabric articles in the laundering solution. To that end, various polymers have been included in detergent compositions to inhibit dye transfer. For example, European Application No. 372 291, Jacobs et al, discloses a process for washing discoloration-sensitive textiles in which the washing or laundering solution contains several water-soluble polymers including N-vinylimidazol, N-vinyloxazolidone, N-vinylpyrrolidone and copolymers thereof to inhibit dye transfer. However, as with most detergent compositions containing dye transfer inhibiting agents, there is a tendency for such agents to decrease cleaning performance. Thus, it would be desirable to have a detergent composition containing dye transfer inhibiting agents which does not suffer from decreased cleaning performance resulting from such agents.

Also in the art of detergency, polymeric soil release agents have been used in detergent compositions to treat fabrics such that subsequently occurring stains are more easily cleaned in later laundering operations. Such polymeric soil release agents are characterized by having both hydrophilic segments, to hydrophilize the surface of hydrophobic fibers, such as polyester and nylon-,and hydrophobic segments, to deposit upon hydrophobic fibers and remain adhered thereto through completion of washing and finishing cycles and thus, serve as an anchor for the hydrophilic segments. This enables subsequent stains to more easily cleaned in later washing cycles.

Typically, soil release agents comprise an oligomeric ester "backbone" and one or more "end-capping⇄ units. While nonionic soil release agents are known in the literature, many of the commercially important soil release agents are anionic. For example, isethionate-derived substiuents of the type $OCH_2CH_2SO_3$ or polyethoxy or propoxy derivatives might be ideal and inexpensive. More specifically, U.S. Pat. No. 4,721,580, Gosselink (commonly assigned), discloses an anionic soil release agent classified as an oligomeric ester composition with end-caps having the formula $NaO_3S(CH_2CH_2O)_n$—.

However, substantial difficulties can occur due to undesirable crystallization of such soil release agents or end-capped units. In response, mixtures of sulfonate-type hydrotropes and the like with the aforementioned soil release agents have resulted in reduced crystallization problems encountered during manufacture, storage and in the laundering solution. These soil release agents, however, have not been combined with dye transfer inhibiting agents for purposes of improving cleaning performance in granular detergent compositions.

Accordingly, despite the disclosures in the art discussed above, there remains a need in the art for a granular detergent composition containing dye transfer inhibiting agents in combination with a soil release agent, together which increase cleaning performance.

SUMMARY OF THE INVENTION

The present invention meets the needs in the art identified above by providing a granular detergent composition containing a mixture of dye transfer inhibiting agents in combination with a soil release agent. The granular detergent composition of the invention unexpectedly exhibits improved cleaning performance. In the past, a decrease in cleaning performance was experienced as a result of the inclusion of dye transfer inhibiting agents in detergent compositions. However, the combination of dye transfer inhibiting agents and specific soil release agents in a detergent composition surprisingly overcome the cleaning deficiencies experienced in the past.

In accordance with one aspect of the invention, a granular detergent composition having improved cleaning performance is provided. More particularly, the granular detergent composition comprises, by weight: (a) from about 1% to about 50% of a detersive surfactant; (b) from about 1% to about 80% of a builder; (c) from about 0.01% to about 10% of a polyamine N-oxide polymer; (d) from about 0.01% to about 10% of a copolymer of N-vinylpyrrolidone and N-vinylimidazole; and (e) from about 0.01% to about 20% of a sulfonated poly-ethoxy/propoxy end-capped ester oligomer. Preferably, the detergent composition of the invention also comprises from about 0.5% to about 20% of a crystallization reducing stabilizer, especially included to prevent crystallization of the ester oligomer.

In another embodiment of the invention, another granular detergent compositions is provided. The detergent composition comprises, by weight: (a) from about 1% to about 50% of a detersive surfactant selected from the group consisting of anionics, nonionics, zwitterionics, ampholytics, cationics and mixtures thereof; (b) from about 1.% to about 80% of a builder selected from group consisting of aluminosilicates, crystalline layered silicates, citrates and mixtures thereof; (c) from about 0.1% to about 1% of a polyvinylpyridine N-oxide polymer; (d) from about 0.1% to about 1% of a copolymer of N-vinylpyrrolidone and N-vinylimidazole; (e) from about 0.01% to about 1% of a sulfonated poly-ethoxy/-propoxy end-capped ester oligomer; and (f) from about 0.5% to about 20% of a crystallization reducing stabilizer selected from the group consisting of sulfonate-based hydrotropes, alkylbenzenesulfonates, paraffin sulfonates and mixtures thereof.

The invention also provides a method for laundering soiled clothes and similar fabric articles. The method of laundering soiled clothes comprises the step of contacting the clothes with an effective amount of a detergent composition according to the invention described herein in an aqueous media. All percentages and ratios referenced herein are expressed on a weight basis unless otherwise indicated.

Accordingly, it is an object of the invention to provide a granular detergent composition containing dye transfer inhibiting agents in combination with a soil release agent together which increase cleaning performance. It is also an object of the invention to provide a method of laundering soiled clothes which incorporates a detergent composition having improved cleaning performance. These and other objects, features and attendant advantages of the present invention will become apparent to those skilled in the an from a reading of the following detailed description of the preferred embodiment and the appended claims.

DETAILED DESCRIPTION OF THE PREFERRED EMBODIMENT

The granular detergent composition of the present invention unexpectedly exhibits improved cleaning performance over past compositions which experienced a decrease in cleaning performance, largely attributed to the inclusion of dye transfer inhibiting agents. However, the combination of dye transfer inhibiting agents and specific soil release agents in the present detergent composition surprisingly overcome such past cleaning deficiencies. While the various components described herein may be included in the detergent composition at a variety of levels and proportions, the following presents the preferred amounts of each component.

The granular detergent composition comprises, by weight: (a) from about 1% to about 50%, more preferably from about 10% to about 40% and, most preferably from about 15% to about 30%, of a detersive surfactant; (b) from about 1% to about 80%, more preferably from about 20% to about 70% and, most preferably from about 30% to about 60%, of a builder; (c) from about 0.01% to about 10%, more preferably from about 03% to about 5% and, most preferably from about 05% to about 1%, of a polyamine N-oxide polymer; (d) from about 0.01% to about 10%, more preferably from about 03% to about 5% and, most preferably from about 05% to about 1%, of a copolymer of N-vinylpyrrolidone and N-vinylimidazole; and (e) from about 01% to about 20%, more preferably from about 05% to about 5% and, most preferably from about 0.1% to about 1% of a sulfonated poly-ethoxy/propoxy end-capped ester oligomer. In a preferred embodiment, the detergent composition of the invention also comprises from about 0.5% to about 20%, more preferably from about 3% to about 10%, of a crystallization reducing stabilizer, especially included to prevent crystallization of the ester oligomer.

Polyamine N-oxide Polymer

In accordance with the invention, the detergent composition preferably contains a polyamine N-oxide polymer. The polyamine N-oxide polymers suitable for use herein contain units having the following structure formula:

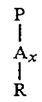

wherein P is a polymerizable unit to which a N—O group can be attached or the N—O group can form part of the polymerizable unit or the N—O group can be attached to both units; A is one of the following structures

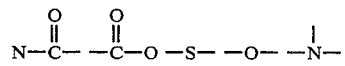

x is 0 or 1; and, R is aliphatic, ethoxylated aliphatics, aromatics, heterocyclic or alicyclic groups or any combination thereof to which the nitrogen of the N—O group can be attached or the N—O group is part of these groups.

The N—O group can be represented by the following general structures:

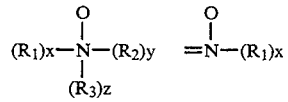

wherein $R_1$, $R_2$, $R_3$ are aliphatic, aromatic, heterocyclic or alicyclic groups or, combinations thereof; x, y and z are 0 or 1; and, the nitrogen of the N—O group can be attached or form part of any of the aforementioned groups. Further, the N—O group can be part of the polymerizable unit (P) or can be attached to the polymeric backbone or a combination of both.

Suitable polyamine N-oxides wherein the N—O group forms part of the polymerizable unit comprise polyamine N-oxides wherein R is selected from aliphatic, aromatic, alicyclic or heterocyclic groups. One class of such polyamine N-oxides comprises the group of polyamine N-oxides wherein the nitrogen of the N—O group forms part of the R group. Preferred polyamine N-oxides are those wherein R is a heterocyclic group such as pyrridine, pyrrole, imidazole, pyrrolidine, piperidine and derivatives thereof.

Another class of the polyamine N-oxides comprises the group of polyamine N-oxides wherein the nitrogen of the N—O group is attached to the R-group. Other suitable polyamine N-oxides are the polyamine oxides in which the N—O group is attached to the polymerizable unit. A preferred class of these polyamine N-oxides are the polyamine N-oxides having the general formula presented above wherein R is an aromatic, heterocyclic or an alicyclic group and the nitrogen of the N—O functional group is part of the R group. Examples of these classes are polyamine oxides wherein R is a heterocyclic compound such as pyrridine, pyrrole, imidazole and derivatives thereof.

Another preferred class of polyamine N-oxides are the polyamine oxides having the general formula presented above wherein R is an aromatic, heterocyclic or alicyclic group and the nitrogen of the N—O functional group is attached to the R group(s). Examples of these classes are polyamine oxides wherein R groups can be aromatic such as phenyl. Any polymer backbone can be used as long as the amine oxide polymer formed is water-soluble and has dye transfer inhibiting properties.

Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1: 1,000,000. However, the number of amine oxide groups present in the polyamine oxide polymer can be varied by appropriate copolymerization or by an appropriate degree of N-oxidation. Preferably, the ratio of amine to amine N-oxide is from 3:1 to 1: 1000000. The polymers of the present invention actually encompass random or block copolymers where one monomer type is an amine N-oxide and the other monomer type is an N-oxide.

The amine oxide unit of the polyamine N-oxides has a pKa $<10$, preferably pKa $<7$, more preferred pKa $<6$. The polyamine oxides can be obtained in almost any degree of polymerization. The degree of polymerization is not critical provided the material has the desired water-solubility and dye-suspending power. Typically, the average molecular weight is within the range of 500 to 1,000,000; more preferred 1,000 to 500,000; most preferred 5,000 to 100,000.

The polyamine N-oxide used in the invention can be synthesized by polymerizing the amine monomer and oxidizing the resulting polymer with a suitable oxidizing agent or the amine oxide monomer may itself be polymerized to obtain the desired polyamine N-oxide. Such reaction schemes are well known and within the scope of those persons skilled in the art.

Copolymer of N-vinylpyrrolidone and N-vinylimidazole

The detergent composition of the present invention preferably also comprises a copolymer of N-vinylpyrrolidone and N-vinylimidazole (also referenced herein as "PVPVI"). It has been found that the copolymer of N-vinylpyrolidone and N-vinylimidazole enhances the detergency performance of certain detergent ingredients formulated therewith. Furthermore, the copolymer of N-vinylpyrolidone and N-vinylimidazole described herein provide excellent dye transfer inhibiting properties.

In a preferred embodiment, the copolymer of N-vinylpyrolidone and N-vinylimidazole polymers has an average molecular weight range from 5,000 to 1,000,000, more preferably from 5,000 to 200,000. A highly preferred copolymer for use in detergent compositions according to the present invention has an average molecular weight range from 5,000 to 50,000, more preferably from 8,000 to 30,000 and, most preferably from 10,000 to 20,000. The average molecular weight range is determined by light scattering as described in Barth J. H. G. and Mays J. W. Chemical Analysis Vol 113. "Modem Methods of Polymer Characterization", the disclosure of which is incorporated herein by reference.

The copolymer of N-vinylpyrolidone and N-vinylimidazole used in the present invention has a molar ratio of N-vinylimidazole to N-vinylpyrrolidone from 1:1 to 0.2: 1, more preferably from 0.8:1 to 0.3:1, most preferably from 0.6:1 to 0.4:1. It should be understood that the copolymer of N-vinylpyrolidone and N-vinylimidazole can be either linear or branched.

Sulfonated Poly-Ethoxy/Propoxy End-Capped Ester Oligomer

The granular detergent composition of the invention also includes a soil release agent, the essential component of which is a particular type of ester characterized by certain essential end-capping units as well as other essential units all in particular proportions and having structural arrangements as described hereinafter. Also encompassed with the soil release agent can be certain stabilizers which reduce the crystallization problems encountered during manufacture and storage of the soil release oligomers as well as when introduced into the laundering solution.

The esters herein can be simply characterized as oligomers which comprise a substantially linear ester "backbone" and end-tapping units which are derived from sulfonated monohydroxy polyethoxy/propoxy monomers, especially 2-(2-hydroxyethoxy)ethanesulfonate. Proper selection of the structural units which comprise the ester backbone and use of sufficient amounts of the sulfonated end-capping units results in the desired soil-release properties of these materials. The integration of stabilizers into the oligomer reduces the crystallization of the oligomer during manufacture and when introduced into the wash liquor, thereby enhancing the dissolution/dispersion and the soil release performance of the esters.

The ester oligomer used herein preferably comprises: (i) from about 1 to about 2 moles of sulfonated polyethoxy/propoxy end-capping units of the formula —($MO_3S$)($CH_2$)m($CH_2CH_2O$)(RO)n-wherein M is a salt forming cation selected from the group consisting of sodium and tetraalkylammonium, m is 0 or 1, R is ethylene, propylene or a mixture thereof, and n is from 0 to 2; (ii) from about 0.5 to about 66 moles of units selected from the group consisting of: a) oxyethyleneoxy units; b) a mixture of oxyethyleneoxy and oxy-1,2-propyleneoxy units wherein said oxyethyleneoxy units are present in an oxyethyleneoxy to oxy-1,2-propyleneoxy mole ratio ranging from 0.5:1 to about 10: 1; and c) a mixture of a) or b) with poly(oxyethylene)oxy units wherein said poly(oxyethylene)oxy units have a degree of polymerization of from 2 to 4; provided that when said poly(oxyethylene)oxy units have a degree of polymerization of 2, the mole ratio of poly(oxyethylene)oxy units to total group ii) units ranges from 0:1 to about 0.33:1; and when said poly(oxyethylene)oxy units have a degree of polymerization of 3, the mole ratio of poly(oxyethylene)oxy units to total group ii) units ranges from 0:1 to about 0.22: 1; and when said poly(oxyethylene oxy units have a degree of polymerization of 4, the mole ratio of poly(oxyethylene)oxy units to total group ii) units ranges from 0:1 to about 0.14: 1; iii) from about 1.5 to about 40 moles of terephthaloyl units; and iv) from 0 to about 26 moles of 5-sulfoisophthaloyl units of the formula —(O)C($C_6H_3$)($SO_3M$)C(O)—wherein M is a salt forming cation.

Oligomeric Esters—It is to be understood that the soil release compositions herein are not resinous, high molecular weight, macromolecular or fiber-forming polyesters but, instead, are relatively low molecular weight and contain species more appropriately described as oligomers rather than as polymers. Individual ester molecules herein, including the end-tapping units, can have molecular weights ranging from about 500 to about 8,000. Relevant for purposes of comparison with glycol-terephthalate fibrous polyesters (typically averaging 15,000 or more in molecular weight) is the molecular weight range from about 500 to about 5,000, within which molecules of the preferred esters of the invention which incorporate the essential units and 5-sulfoisophthalate are generally found. Accordingly, the soil release agents used in the detergent composition of this invention are referred to as "oligomeric esters" rather than "polyester" in the colloquial sense of that term as commonly used to denote high polymers such as fibrous polyesters.

Molecular Geometry—The esters employed herein are all "substantially linear" in the sense that they are not significantly branched or crosslinked by virtue of the incorporation into their structure of units having more than two ester-bond forming sites. (By contrast, a typical example of polyester branching or crosslinking of the type excluded in defining esters of the present invention, see Sinker et al, U.S. Pat. No. 4,554,328, issued Nov. 19, 1985.) Furthermore, no cyclic esters are essential for the purposes of the soil release agent used herein but may be present in the detergent compositions of the invention at low levels as a result of side-reactions during ester synthesis. Preferably, cyclic esters will not exceed about 2% by weight of the compositions; most preferably, they will be entirely absent from the compositions.

Contrasting with the above, the term "substantially linear" as applied to the esters herein does, however, expressly encompass materials which contain side-chains which are unreactive in ester-forming or transesterification reactions. Thus, oxy-1,2-propyleneoxy units are of an unsymmetrically substituted type; their methyl groups do not constitute what is conventionally regarded as "branching" in polymer technology (see Odian, Principles of Polymerization, Wiley, N.Y., 1981, pages 18–19, the disclosure of which is incorporated herein by reference and with which the present definitions are fully consistent) and are unreactive in ester-forming reactions. Optional units in the esters of the soil release agent used herein can likewise have side-chains, provided that they conform with the same nonreactivity criterion.

Molecular Structures—The following structures are illustrative of structures of ester molecules falling within the foregoing preferred embodiments, and demonstrate how the units are connected:

a) doubly end-capped ester molecule comprised of the essential units i), ii) and iii);

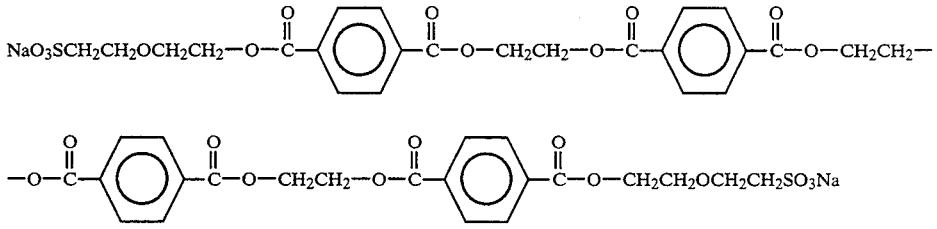

b) singly end-capped ester molecule comprised of essential units i), ii) and iii);

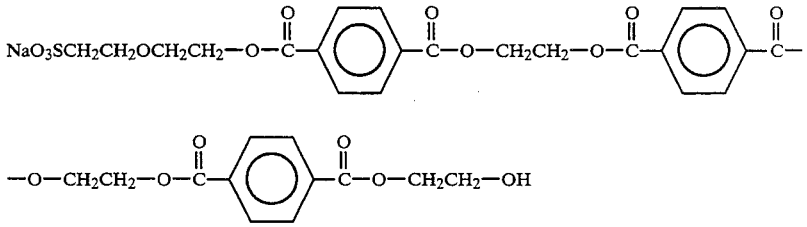

c) doubly end-capped ester molecule, (termed a "hybrid backbone" ester molecule herein) comprised of essential units i), ii) and iii). Units ii) are a mixture of oxyethyleneoxy and oxy-1,2-propyleneoxy units, in the example shown below at a 2:1 mole ratio (on average, in ester compositions as a whole in contrast to individual molecules such as illustrated here, ratios ranging from about 1:1 to about 0: 1 are the most highly preferred when the compositions are based on the units i), ii) and iii));

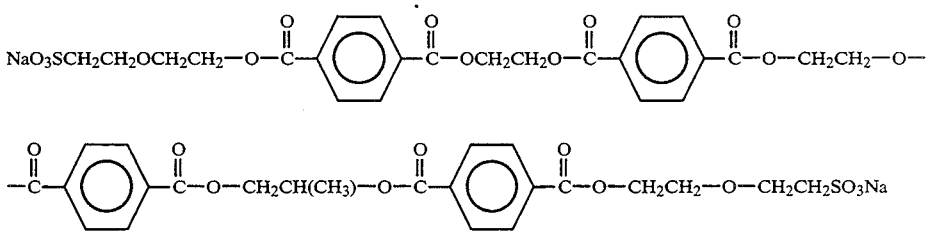

d) doubly end-capped ester molecule comprised of essential units i), ii) and iii), together with an optional unit iv). On average, in ester compositions as a whole in contrast to individual molecules such as illustrated below, the most highly preferred ratios of oxyethyleneoxy to oxy-1,2-propyleneoxy units range from about 0.5:1 to 1:0 when the compositions are based on units i), ii), iii) and iv);

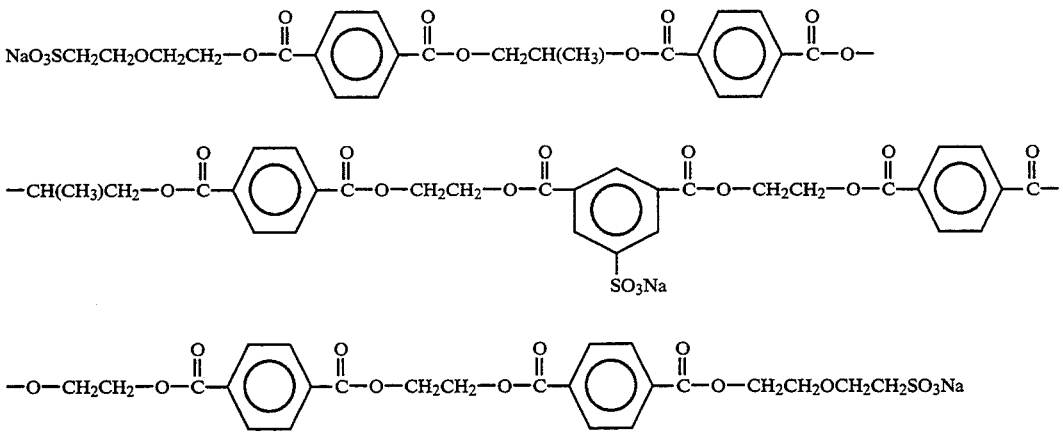

Of the numerous structures disclosed herein, the most preferable soft release polymer has the following general structure

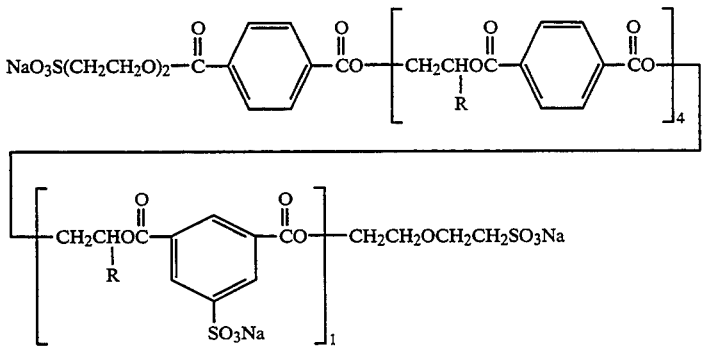

wherein R is H or $CH_3$in a ratio of 1.8:1 .

In the context of the structures of ester molecules disclosed herein it should be recognized that they encompass not only the arrangement of units at the molecular level but also the gross mixtures of esters which result from the reaction schemes herein and which have the desired range of composition and properties. Accordingly, when the number of monomer units or ratios of units are given, the numbers refer to an average quantity of monomer units present in oligomers of the composition.

Ester Backbone—As illustrated in the structures shown above, in the esters of the soil release agent used herein, the backbone is formed by oxyethyleneoxy and terephthaloyl units connected in alternation. Optionally, the backbone is formed by 5-suffoisophthaloyl units, 35 terephthaloyl units, oxyethyleneoxy or mixtures of oxyethyleneoxy, oxypropyleneoxy and poly-(oxyethyleneoxy) units connected with alternation of the aryldicarbonyl and oxyalkyleneoxy units.

Groups at the Termini of the Ester Backbone—Likewise, the "esters of the soil release agents used herein" is a phrase which encompasses the novel doubly and singly end-capped compounds disclosed herein, mixtures thereof, and mixtures of said end-capped materials which may unavoidably contain some non-capped species. Although, levels of the latter will be zero or at a minimum in all of the highly preferred compositions. Thus, when referring simply to an "ester" herein it is intended to refer, by definition, collectively to the mixture of sulfonated capped and uncapped ester molecules resulting from any single preparation.

Any ester molecules which are present in compositions of the invention which are not fully, i.e., doubly, end-capped by the end-capping units must terminate with units which are not sulfonated poly-ethoxy/-propoxy end-capping units. These termini will typically be hydroxyl groups or other groups attributable to the unit-forming reactant. For example in the structure b) above, a chain terminal position to which is attached -H forms a hydroxyl group. In other structures which may be constructed, units such as —(O)$CC_6H_4C$(O)—$OCH_3$ may be found in terminal positions. All the most highly preferred ester molecules herein will, however, as indicated above, have two sulfonated end-capping units and no backbone units occupying terminal positions.

Symmetry—It is to be appreciated that in esters in which oxy- 1,2-propyleneoxy units are also present, the oxy- 1,2-propyleneoxy units can have their methyl groups randomly alternating with one of the adjacent —$CH_2$—hydrogen atoms, thereby lowering the symmetry of the ester chain. Thus, the oxy 1,2propyleneoxy unit can be depicted as having either the —$OCH_2CH(CH_3)O$—orientation or as having the opposite —$OCH(CH_3)CH_2O$—orientation. Carbon atoms in the oxy- 1,2-propylene units to which the methyl groups are attached are, furthermore, asymmetric, i.e., chiral; they have four nonequivalent chemical entities attached.

In contrast to the oxy- 1,2-propyleneoxy units, oxyethyleneoxy units cannot be used herein as a sole source of oxy- 1,2-alkyleneoxy units without the addition of stabilizers since they lack the needed unsymmetrical character. It is the presence of the unsymmetrical units and/or of the stabilizers that inhibit the crystallization of the oligomer during manufacture and later when added to the wash liquor. The use of oxyethyleneoxy units or high ratios of oxyethyleneoxy to oxypropyleneoxy units, therefore, must be accompanied by the use of stabilizers to retard the formation of crystals. Accordingly, such compositions herein contain sulfonate-type hydrotropes, linear or branched alkylbenzenesulfonates, paraffin sulfonates, and mixtures thereof integrated into the oligomer composition.

Preferably, various optional units of a hydrophilicity-enhancing and nonpolyester substantive type can be incorporated into the esters. The pattern of such incorporation will generally be random. Preferred optional units are anionic hydrophiles, such as 5-sulfoisophthaloyl or similar units. Such units will, when incorporated into the ester backbone, generally divide it into two or more hydrophobic moieties separated by one or more hydrophilic moieties.

It should also be noted that the essential non-charged aryldicarbonyl units herein need not exclusively be terephthaloyl units, provided that the polyester fabric-substantively of the ester is not harmed to a significant extent. Thus, for example, minor amounts of isomeric non-charged dicarbonyl units, such as isophthaloyl or the like, are acceptable for incorporation into the esters.

Poly(oxyethylene)oxy Units—The optional poly(oxyethylene)oxy units comprising the esters of the soil release agent used herein have a degree of polymerization of from 2 to 40 and can constitute from 0 to about 25 mole percent of the total oxyalkyleneoxy units present. Preferably, poly(oxyethylene)oxy units are present when the backbone unit comprises 8 or more terephthaloyl units; however, at least some poly(oxyethylene)oxy units may be present in esters with as few as 1.5 terephthaloyl units. The poly(oxyethylene)oxy units, especially in esters with 8 or more terephthaloyl units, aid in the rate of dissolution of the soil release agent into the wash liquor.

The amount of poly(oxyethylene)oxy units present in the backbone is related to its degree of polymerization. For example, oxyethyleneoxyethyleneoxy units (formed from diethylene glycol), which have a degree of polymerization of two, can constitute from 0 to 25 mole percent of the total oxyalkyleneoxy units in the backbone. The $(oxyethylene)_3$ units (formed from triethylene glycol), which have a degree of polymerization of three, can constitute from 0 to 18 mole percent of the total oxyalkyleneoxy units in the backbone. The $(oxyethylene)_3$ units (formed from tetraethylene glycol), which have a degree of polymerization of four, can constitute from 0 to 12 mole percent of the total oxyalkyleneoxy units present in the backbone.

End-Capping Units—The end-tapping units used in the esters of the soil release agents used herein are sulfonated poly-ethoxy/propoxy groups. These end-cap units provide anionic charged sites when the esters are dispersed in aqueous media, such as a laundry liquor. The end-caps serve to assist transport in aqueous media and to provide hydrophilic sites on the ester molecules.

It is not intended to exclude the acid form, but most generally the esters herein are used as sodium salts, as salts of other alkali metals, as salts with nitrogen-containing cations (especially tetraalkylammonium), or as the disassociated ions in an aqueous environment. Examples of end-capping groups include sodium isethionate, sodium 2—(2-hydroxyethoxy)ethanesulfonate, sodium 2-[2-(2-hydroxyethoxy)ethoxy]ethanesulfonate, sodium 5-hydroxy 4-methyl-3-oxa-pentanesufonate, sodium alpha-3-sulfopropyl-omega-hydroxy- poly—-(oxy- 1,2-ethanediyl) (with an average degree of ethoxylation of 1-2), sodium 5-hydroxy- 3-oxa-hexanesulfonate, and mixtures thereof.

On a mole basis, the soil release agent herein will preferably comprise from about one to about two moles of the sulfonated end-capping units per mole of the ester. Most preferably, the esters are doubly end-capped; i.e., there will be two moles of end-capping units present per mole of the esters. From the viewpoint of weight composition, it will be clear that the fractional contribution of end-tapping units to the molecular weight of the esters will decrease as the molecular weight of the ester backbone increases.

Method for Making End-Capped Esters—The ester compositions of the present invention can be prepared using any one or combination of several alternative general reaction types, each being well-known in the art. Many different starting materials and diverse, well-known experimental and analytical techniques are useful for the syntheses.

Mechanistically, the suitable general reaction types for preparing esters of the invention include those classifiable as:

1. alcoholysis of acyl halides;
2. esterification of organic acids;
3. alcoholysis of esters (transesterification); and
4. reaction of alkylene carbonates with organic acids.

Of the above, reaction types 2-4 are highly preferred since they render unnecessary the use of expensive solvents and halogenated reactants. Reaction types 2 and 4 are especially preferred as being the most economical.

Suitable starting materials or reactants for making the esters of this invention are any reactants (especially esterifiable or transesterifiable reactants) that are capable of combining in accordance with the reaction types 1–4, or combinations thereof, to provide esters having the correct proportions of all the above-specified units (i) to (iv) of the esters. Such reactants can be categorized as "simple" reactants, i.e., those that are singly capable of providing only one kind of unit necessary for making the esters, or as derivatives of the simple reactants which singly contain two or more different types of unit necessary for making the esters. Illustrative of the simple kind of reactant is dimethyl terephthalate which can provide only terephthaloyl units. In contrast, bis(2-hydroxypropyl)terephthalate is a reactant which can be prepared from dimethyl terephthalate and 1,2-propylene glycol and which can desirably be used to provide two kinds of unit, viz. oxy-1,2propyleneoxy and terephthaloyl, for making the esters herein.

In principle it is also possible to use oligoesters, or polyesters such as poly(ethylene terephthalate), as reactants herein and to conduct transesterification with a view to incorporation of end-capping units while decreasing molecular weight. Nonetheless, the more highly preferred procedure is to make the esters from the simplest reactants in a process involving molecular weight increase (to the limited extent provided for by the invention) and end-capping.

When starting with the simplest reactants as described above, the overall synthesis is usually multi-step and involves at least two stages, such as an initial esterification or trans-esterification (also known as ester interchange) stage followed by an oligomerization stage in which molecular weights of the esters are increased, but only to a limited extent as provided for by the invention.

Formation of ester-bonds in reaction types 2 and 3 involves elimination of low molecular weight by-products such as water (reaction 2) or simple alcohols(reaction 3). Complete removal of the latter from reaction mixtures is generally somewhat easier than removal of the former. However, since the ester-bond forming reactions are generally reversible, it is necessary to "drive" the reactions forward in both instances by removing these by-products.

In practical terms, in the first stage (ester interchange) the reactants are mixed in appropriate proportions and are heated to provide a melt at atmospheric or slightly superatmospheric pressures (preferably of an inert gas such as nitrogen or argon). Water and/or low molecular weight alcohol is liberated and is distilled from the reactor at temperatures up to about 200° C. (A temperature range of from about 150°–200° C. is generally preferred for this stage.)

In the second (i.e., oligomerization) stage, vacuum and temperatures somewhat higher than in the first stage are applied; removal of volatile by-products and excess reactants continues until the reaction is complete, as monitored by conventional spectroscopic techniques. Continuously applied vacuum, typically of about 30 mm Hg or lower, can be used. Addition of a small amount of an anti-foam agent, such as a silicone oil or mineral oil can be employed to control foaming during the vacuum oligomerization step, particularly with stabilizers such as alkyl benzenesulfonate.

In both of the above-described reaction stages, it is necessary to balance on one hand the desire for rapid and complete reaction (higher temperatures and shorter times preferred), against the need to avoid thermal degradation (which undesirably might result in off-colors and by-products). It is possible to use generally higher reaction temperatures especially when reactor design minimizes super-heating or "hot spots"; also, ester-forming reactions in which ethylene glycol is present are more tolerant of higher temperatures. Thus, a suitable temperature for oligomerization lies most preferably in the range of from about 150° C. to about 260° C. when higher ratios of EG/PG are present and in the range of from about 150° to about 240° C. when lower ratios of EG/PG are present (assuming that no special precautions, such as of reactor design, are otherwise taken to limit thermolysis). When tetraalkylammonium cations are present, condensation temperatures are preferably 150°–240° C.

It is very important in the above-described procedure to use continuous mixing so that the reactants are always in good contact; highly preferred procedures involve formation of a well-stirred homogeneous melt of the reactants in the temperature ranges given above. It is also highly preferred to maximize the surface area of reaction mixture which is exposed to vacuum or inert gas to facilitate the removal of volatiles, especially in the oligomerization step; mixing equipment of a high-shear vortex-forming type giving good gas-liquid contact are best suited for this purpose.

Catalysts and catalyst levels appropriate for esterification, transesterification, oligomerization, and for combinations thereof are all well-known in polyester chemistry and will generally be used herein; as noted above, a single catalyst will suffice. Suitable cataytic metals are reported in Chemical Abstracts, CA83: 178505v, which states that the catalytic activity of transition metal ions during direct esterification of K and Na carboxybenzenesulfonates by ethylene glycol decreases in the order Sn (best), Ti, Pb, Za, Mn, Co (worst).

The reactions can be continued over periods of time sufficient to guarantee completion, or various conventional analytical monitoring techniques can be employed to monitor progress of the forward reaction; such monitoring makes it possible to speed up the procedures somewhat and to stop the reaction as soon as a product having the minimum acceptable composition is formed. In general, when tetraalkylammonium cations are present, it is preferred to stop the reaction at less than full completion, relative to the sodium cation form, to reduce the possibility of thermal instability. Appropriate monitoring techniques include measurement of relative and intrinsic viscosities, hydroxyl numbers, $^{1}H$ and $^{13}C$ nuclear magnetic resonance (n.m.r.) spectra, capillary zone electrophoresis, and liquid chromatograms.

Most conveniently, when using a combination of volatile reactants (such as a glycol) and relatively involatile reactants (such as dimethyl terephthalate), the reaction will be initiated with excess glycol being present. As in the case of ester interchange reactions reported by Odian (op. cit.), "stoichiometric balance is inherently achieved in the last stages of the second step of the process". Excess glycol can be removed from the reaction mixture by distillation; thus, the exact amount used is not critical.

Inasmuch as the final stoichiometry of the ester compositions depend on the relative proportions of reactants retained in the reaction mixtures and incorporated into the esters, it is desirable to conduct the condensations in a way which effectively retains the non-glycol reactants and prevents them from distilling or subliming. Dimethyl terephthalate and to a lesser extent the simple glycol esters of terephthalic acid have sufficient volatility to show on occasion "sublimation" to cooler parts of the reaction apparatus. To ensure achieving the desired stoichiometry it is desirable that this sublimate be returned to the reaction mixture or, alternatively, that sublimation losses be compensated by use of a small excess of terephthalate.

In general, sublimation-type losses, such as of dimethyl terephthalate, may be minimized 1) by apparatus design; 2) by raising the reaction temperature slowly enough to allow a large proportion of dimethyl terephthalate to be convened to less volatile glycol esters before reaching the upper reaction temperatures; 3) by conducting the early phase of the transesterification under low to moderate pressure (especially effective is a procedure allowing sufficient reaction time to evolve at least about 90% of the theoretical yield of methanol before applying vacuum); 4) by controlling vacuum during condensation to avoid use of pressures below about 20 mm Hg until the condensation has progressed to the point that most of the terephthalate is beyond the monomeric stage. On the other hand, the "volatile" glycol components used herein must be truly volatile if an excess is to be used. In general, lower glycols or mixtures thereof having boiling points below about 350° C. atmospheric pressure are used herein; these are volatile enough to be practically removable under typical reaction conditions.

Typically herein, when calculating the relative proportions of reactants to be used, the following routine is followed as illustrated for a combination of the reactants sodium 2—(2-hydroxyethoxy) ethanesulfonate (A), ethylene glycol (B) dimethyl terephthalate (C), and dimethyl 5-sodiosulfoisophthalate (D):

1. the desired degree of end-capping is selected; for the present example, the value 2, most highly preferred according to the invention, is used;
2. the average calculated number of terephthaloyl units in the backbone of the desired ester is selected; for the present example, the value 5, which falls in the range of most highly preferred values according to the invention, is used;
3. the average calculated number of 5-sulfoisophthaloyl units in the backbone of the desired ester is selected; for the present example, the value 1, which falls in the range of most highly preferred values according to the invention, is used;
4. the mole ratio of(A) to (C) to (D) should thus be 2:5:1; amounts of the reactants (A), (C), and (D) are taken accordingly;
5. an appropriate excess of glycol is selected; typically 2 to 10 times the sum of the number of moles of dimethyl sulfoisophthalate and dimethyl terephthalate is suitable.

The glycol used will be calculated in an amount sufficient to allow interconnection of all other units by means of ester bonds. Adding a convenient excess will usually result in a total relative amount of glycol ranging from about 1 to about 10 moles for each mole non-glycol organic reactants added together.

The sulfonate-type hydrotropes, linear or branched alkylbenzene sulfonates, and paraffin sulfonate stabilizers may be added to the oligomer at various stages prior to full oligomerization or by first melting the preformed oligomer and then homogeneously mixing the stabilizer into the molten oligomer. The key is to create a uniform integration of the stabilizer into the oligomer.

Crystalline Reducing Stabilizers

Stabilizers useful in the detergent composition of the invention should be water soluble or water dispersible. The stabilizing agents that are useful herein include sulfonate-type hydrotropes, linear or branched alkylbenzenesulfonates, paraffin sulfonates, and other thermally-stable alkyl sulfonate variations with from about 4 to about 20 carbon atoms. Preferred stabilizers include sodium dedecylbenzenesulfonate, sodium cumenesulfonate, sodium toluenesulfonate, sodium xylenesulfonate, and mixtures thereof. When higher levels of stabilizers are used, mixtures of hydrotropes and/or other stabilizers are preferred over pure components to insure full integration into the oligomer and to reduce the possibility of crystallization of the stabilizer. In general, the level of such stabilizers should be kept as low as possible while providing the primary benefit, i.e., the reduction in the amount of crystallization that the soil release agent undergoes during manufacture, storage and when introduced to the wash liquor. The composition may comprise from about 0.5% to about 20% stabilizer. Most: preferably, the ester soil release agents comprise an amount sufficient to reduce the crystallization of the oligomer during manufacture and when introduced to the wash liquor, i.e., at least 3% by weight.

The stabilizers may be added to the soil release agent in various ways. Preferably, the stabilizers are added to the oligomer reagents in the initial stages prior to full oligomerization. The stabilizers thereby integrate uniformly into the oligomer. Another method would entail first melting the pre-formed oligomer and then uniformly mixing the stabilizer into the molten oligomer. Alkylbenzenesulfonates when used as surfactants in detergent compositions do not provide the stabilizing and crystallization-reducing effect, even during dissolution of the soil release agent in the laundry liquor, that the stabilizer does when it is added as directed above.

Detersive Surfactant

The detersive surfactants preferably used in the detergent composition of the invention are preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference.

Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred. The following are representative examples of detergent surfactants useful in the present granules. Water-soluble salts of the higher fatty acids, i.e., "soaps" , are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional anionic surfactants which suitable for use herein include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl ethylene oxide ether sulfates containing about 1 to about 10 units of ethylene oxide per molecule and wherein the alkyl group contains from about 10 to about 20 carbon atoms.

In addition, suitable anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred anionic surfactants are $C_{10-18}$ linear alkylbenzene sulfonate and $C_{10-18}$ alkyl sulfate. If desired, low moisture (less than about 25% water) alkyl sulfate paste can be the sole surfactant ingredient in the detergent composition. Most preferred is a combination of the two. A preferred embodiment of the present invention is wherein the doughy mass comprises from about 20% to about 40% of a mixture of sodium $C_{10-13}$ linear alkylbenzene sulfonate and sodium $C_{12-16}$ alkyl sulfate in a ratio of about 2:1 to 1:2.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

An additional group of nonionics suitable for use herein are semi-polar nonionic surfactants which include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about i0 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$–$C_{16}$ alkyl group or a $C_8$–$C_{12}$ alkyl phenyl group, and n is from 3 to about 80. Particularly preferred are condensation products of $C_{12}$–C 15 alcohols with from about 5 to about 20 moles of ethylene oxide per mole of alcohol, e.g., $C_{12}$–$C_{13}$ alcohol condensed with about 6.5 moles of ethylene oxide per mole of alcohol.

Additional suitable nonionic surfactants include polyhydroxy fatty acid amides of the formula

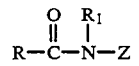

wherein R is a $C_{9-17}$ alkyl or alkenyl, $R_1$ is a methyl group and Z is glycityl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Paten No. 2,703,798, the disclosures of which are incorporated herein by reference.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ting compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, the disclosure of which is incorporated herein by reference.

Detergent Builder

The detergent composition preferably contains a detergent builder. Builders suitable for use herein include silicates, borates, polyhydroxy sulfonates, polyacetates, and nonphosphorous, inorganic builders. Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, convened to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized herein, as well. Aluminosilicates including zeolites are suitable for use herein and are more fully discussed in Corkill et al, U.S. Pat. No. 4,605,509, the disclosure of which is incorporated herein by reference. Also, crystalline layered silicates such as those discussed in Corkill et al, U.S. Pat. No. 4,605,509, incorporated herein by reference, are suitable for use in the detergent composition of the invention.

Optional Detergent Ingredients

The detergent composition of the present invention can also include any number of additional ingredients. These include other detergency builders, suds boosters or suds suppressers, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., the disclosure of which is incorporated herein by reference.

Additional dye transfer inhibiting agents may also be included, for example, polyvinylpyrrolidone is a suitable dye transfer inhibiting polymer for use in the present detergent composition. The level of such additional dye transfer inhibiting agents may vary, but typically will be from about 0.01% to about 10% by weight of the detergent composition.

Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference. Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

While not essential to the detergent composition of the invention, it is preferable to include an enzyme. Suitable enzyme components are available from a wide variety of commercial sources. For example, suitable enzymes are available from NOVO Industries under product names T-Granulate TM and Savinase TM, and Gist-Brocades under product names Maxacal TM and Maxatase TM. Included within the group of enzymes are proteases, amylases, lipases, cellulases and mixtures thereof.

The enzyme level preferably should be from about 0% to about 5%, more preferably from about 0.1% to about 2.5%, and most preferably from about 0.2% to about 1%. Typically, proteases are used at an Activity Unit (Anson Unit) level of from about. 0.001 to about 0.05, most preferably from about 0.002 to about 0.02, while amylases are used at an amylase unit level of from about 5 to about 5000, most preferably from about 50 to about 500 per gram of detergent composition.

In order to make the present invention more readily understood, reference is made to the following examples, which are intended to be illustrative only and not intended to be limiting in scope.

EXAMPLE I

The following Example presents granular detergent compositions A, B, C, D and E, of which composition E is made within the scope of the invention while compositions A–D are outside the present invention. More specifically, composition D includes the dye transfer inhibiting agents, polyamine N-oxide polymer and a copolymer of N-vinylpyrrolidone and N-vinylimidazole, and the soil release agent, sulfonated poly-ethoxy/propoxy end-capped ester oligomer. For purposes of comparison, composition A does not include such a soil release agent or dye transfer inhibiting agents; compositions B and C only include one dye transfer inhibiting agent, namely polyamine N-oxide polymer and a copolymer of N-vinylpyrrolidone and N-vinylimidazole, respectively; and composition D includes both dye transfer inhibiting agents but no soil release agent.

TABLE I

| | Compositions (% weight) | | | | |
|---|---|---|---|---|---|
| Finished Formula | A | B | C | D | E |
| $C_{11-14}$ linear alkylbenzene sulfonate | 11.6 | 11.6 | 11.6 | 11.6 | 11.6 |
| $C_{11-14}$ alkyl ethoxy sulfate (EO 0.6) | 9.5 | 9.5 | 9.5 | 9.5 | 9.5 |
| Aluminosilicate | 28.0 | 28.0 | 28.0 | 28.0 | 28.0 |
| Polyacrylate | 2.5 | 2.5 | 2.5 | 2.5 | 2.5 |
| Polyethylene glycol (MW 4000) | 0.9 | 0.9 | 0.9 | 0.9 | 0.9 |
| Sodium carbonate | 28. | 28.2 | 28.2 | 28.2 | 28.2 |
| Protease enzyme | 0.3 | 0.3 | 0.3 | 0.3 | 0.3 |
| Lipase enzyme | 0.3 | 0.3 | 0.3 | 0.3 | 0.3 |
| Cellulase enzyme | 0.6 | 0.6 | 0.6 | 0.6 | 0.6 |
| Sodium perborate | 0.7 | 0.7 | 0.7 | 0.7 | 0.7 |
| Water | 9.7 | 9.7 | 9.7 | 9.7 | 9.7 |
| Soil release agent[1] | — | — | — | — | 0.5 |
| PVNO[2] | — | 0.2 | — | 0.1 | 0.1 |
| PVNO[3] | — | — | 0.2 | 0.1 | 0.1 |
| Misc (perfumes, etc.) | 7.7 | 7.5 | 7.5 | 7.5 | 7.0 |

TABLE I-continued

| Finished Formula | Compositions (% weight) | | | | |
|---|---|---|---|---|---|
| | A | B | C | D | E |
| | 100.00 | 100.0 | 100.0 | 100.0 | 100.0 |

[1]Sulfonated-based poly-ethoxy/propxy end-capped ester oligomer
[2]Polyvinylpyrridine N-oxide
[3]Copolymer of N-vinylpyrrolidone and N-vinylimidazole (MW 10,000)

Compositions A–E are formulated for use at a level of about 1400 ppm, wash water weight basis, and at temperatures below about 50° C. The above compositions are generally made by combining base granule ingredients (e.g. surfactants, builders, water, etc.) as a slurry, and spray drying the resulting slurry to a low level of residual moisture (5–12%). The remaining dry ingredients are admixed in granular powder form with the spray dried granules in a rotary mixing drum and the liquid ingredients (e.g. enzymes, binders and perfumes) are sprayed onto the resulting granules to form the finished detergent composition.

EXAMPLE II

For purposes of demonstrating the improved cleaning performance obtained with detergent compositions of the invention, compositions A–E in Table I of Example I are used to wash soiled items with water having a hardness level of about 6 grains/gallon in conventional full-scale laundry washing machines with 12 minute wash cycles, after which the items are dried for 50 minutes in conventional dryers. Panelists are asked to compare the clothes washed with detergent compositions B–E with the those clothes washed with detergent composition A and assign grades according to the following scale:

0 =no difference between two samples
1 =think there is a difference
2 =known there is a little difference
3 =known there is a lot of difference
4 =known there is a whole lot of difference Each panelist grades the samples under standard lighting. Table II provides the results for compositions A–E. Composition A is normalized to a PSU score of "0" so as to provide a framework for comparing cleaning performance.

TABLE II

| Stain Fabric | PSU | | | | |
|---|---|---|---|---|---|
| | A | B | C | D | E |
| Clay (cotton) | 0.0 | 0.5 | −0.8 | 0.1 | 0.9 |
| Clay (poly/cotton) | 0.0 | 1.3 | −0.2 | 0.4 | 1.2 |
| Grass (cotton) | 0.0 | 0.8 | 0.5 | −0.1 | 1.4 |
| Animal Blood (cotton) | 0.0 | −0.4 | −0.9 | −0.7 | 0.3 |
| Chocolate Pudding (cotton) | 0.0 | −0.2 | −1.1 | −0.6 | 0.2 |
| Spaghetti Sauce (poly/cotton) | 0.0 | −0.6 | −0.8 | −0.2 | 0.9 |
| Spahgetti Sauce (cotton) | 0.0 | −0.6 | −0.5 | −0.6 | −0.9 |
| Bacon Grease (poly/cotton) | 0.0 | −0.2 | 0.4 | 0.3 | 0.4 |
| Tea (poly/cotton) | 0.0 | 0.9 | 0.6 | 0.7 | 0.4 |

From the results shown in Table II, it is apparent that granular detergent compositions A, B, C and D, all of which do not contain the combination of polyamine N-oxide polymer, a copolymer of N-vinylpyrrolidone and N-vinylimidazole, and a sulfonated poly-ethoxy/-propoxy end-capped ester oligomer, generally do not perform as well as composition E which is made in accordance with the invention described herein. Accordingly, composition E unexpectedly provides improved cleaning over compositions A–D which are outside the scope of the invention.

Having thus described the invention in detail, it will be obvious to those skilled in the art that various changes may be made without departing from the scope of the invention and the invention is not to be considered limited to what is described in the specification.

What is claimed is:

1. A granular detergent composition comprising, by weight:

(A) from about 1% to about 50% of a detersive surfactant (B) from about 1% to about 80% of a builder (C) from about 0.01% to about 10% of a polyamine N-oxide polymer;

(D) from about 0.01% to about 10% of a copolymer of N-vinylpyrrolidone and N-vinylimidazole; and (E) from about 0.01% to about 20% of a sulfonated poly-ethoxy/propoxy end-capped ester oligomer comprising (i) from about 1 to about 2 moles of sulfonated poly-ethoxy/propoxy end-capping units of the formula $(MO_3S)(CH_2)_m(CH_2CH_2O)(RO)_n$— wherein M is a salt forming cation selected from the group consisting of sodium and tetraalkylammonium, m is 0 or 1, R is ethylene, propylene or a mixture thereof, and n is from 0 to 2;

(ii) from about 0.5 to about 66 moles of units selected from the group consisting of: a) oxyethyleneoxy units; b) a mixture of oxyethyleneoxy and oxy-1,2-propyleneoxy units wherein said oxyethyleneoxy units are present in an oxyethyleneoxy to oxy-1,2-propyleneoxy mole ratio ranging from 0.5:1 to about 10:1; and c) a mixture of a) or b) with poly(oxyethylene)oxy units wherein said oligomer; poly(oxyethylene)oxy units have a degree of polymerization of from 2 to 4; provided that when said poly(oxyethylene)oxy units have a degree of polymerization of 2, the mole ratio of poly(oxyethylene)oxy units to total group ii) units ranges from 0:1 to about 0.33:1; and when said poly(oxyethylene)oxy units have a degree of polymerization of 3, the mole ratio of poly(oxyethylene)oxy units to total group ii) units ranges from 0:1 to about 0.22:1; and when said poly(oxyethylene oxy units have a degree of polymerization of 4, the mole ratio of poly(oxyethylene)oxy units to total group ii) units ranges from 0:1 to about 0.14:1;

(iii) from about 1.5 to about 40 moles of terephthaloyl units; and iv) from 0 to about 26 moles of 5-sulfoisophthaloyl units of the formula $—(O)C(C_6H_3)(SO_3M)-C(O)—$ wherein M is a salt forming cation.

2. The granular detergent composition of claim 1 further comprising from about 0.5% to about 20% of a crystallization reducing stabilizer.

3. The granular detergent composition of claim 2 wherein said crystallization reducing stabilizer is selected from the group consisting of sulfonate-based hydrotropes, alkylbenzenesulfonates, paraffin sulfonates and mixtures thereof.

4. The granular detergent composition of claim 1 wherein said copolymer of N-vinylpyrrolidone and N-vinylimidazole has a molecular weight from about 5000 to about 1,000,000.

5. The granular detergent composition of claim 1 wherein said copolymer of N-vinylpyrrolidone and N-vinylimidazole has a molecular weight from about 8000 to about 30,000.

6. The granular detergent composition of claim 1 wherein said builder is selected from the group consisting of aluminosilicates, crystalline layered silicates, citrates and mixtures thereof.

7. The granular detergent composition of claim 1 wherein said detersive surfactant is selected from the group consisting of anionics, nonionics, zwitterionics, ampholytics, cationics and mixtures thereof.

8. A granular detergent composition comprising, by weight:

(a) from about 1% to about 50% of a detersive surfactant;

(b) from about 1% to about 80% of a builder;

(c) from about 0.01% to about 10% of a polyamine N-oxide polymer;

(d) from about 0.01% to about 10% of a copolymer of N-vinylpyrrolidone and N-vinylimidazole; and (e) from about 0.01% to about 20% of a sulfonated poly-ethoxy/propoxy end-capped ester oligomer of the formula:

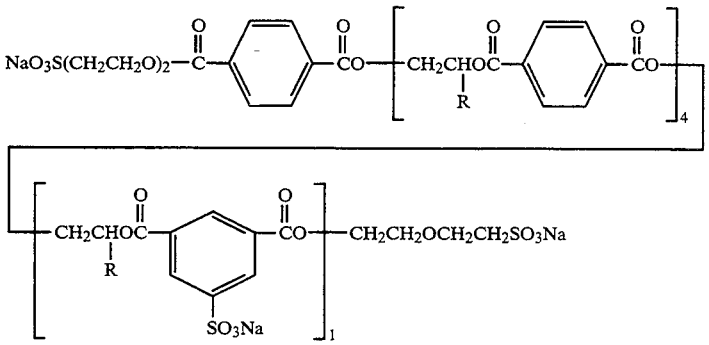

wherein R is H or $CH_3$ in a ratio of 1.8:1

9. A method of laundering soiled clothes comprising the step contacting said clothes with an effective amount of a detergent composition according to claim 1 in an aqueous medium.

10. The granular detergent composition of claim 1 wherein said ester oligomer has a molecular weight from about 500 to about 5,000.

11. A method of laundering soiled clothes comprising the step of contacting said clothes with an effective amount of a detergent composition according to claim 8 in an aqueous medium.

12. A granular detergent composition according to claim 1, which composition comprises by weight:

(a) a detersive surfactant selected from the group consisting of anionics, nonionics, zwitterionics, ampholytics, cationics and mixtures thereof;

(b) a builder selected from group consisting aluminosilicates, crystalline layered silicates, citrates and mixtures thereof;

(c) from about 0.1% to about 1% of a polyvinylpyridine N-oxide polymer;

(d) from about 0.1% to about 1% of a copolymer of N-vinylpyrrolidone and N-vinylimidazole;

(e) from about 0.01% to about 1% of the sulfonated poly-ethoxy/propoxy end-capped ester oligomer; and (f) from about 0.5% to about 20% of a crystallization reducing stabilizer selected from the group consisting of sulfonate-based hydrotropes, alkylbenzene-sulfonates, paraffin sulfonates and mixtures thereof.

13. The granular detergent composition of claim 12 wherein said crystallization reducing stabilizer is a sulfonate-based hydrotrope.

14. A method of laundering soiled clothes comprising the step of contacting said clothes with an effective amount of a detergent composition according to claim 12 in an aqueous medium.

* * * * *